US005482434A

United States Patent [19]

Heaven

[11] Patent Number: 5,482,434

[45] Date of Patent: Jan. 9, 1996

[54] WAVE PADDLE

[76] Inventor: Jonathan M. Heaven, #35 2300 Walkers Line, Burlington, Ontario, Canada

[21] Appl. No.: 415,619

[22] Filed: Apr. 3, 1995

[51] Int. Cl.[6] ..... A45B 27/00

[52] U.S. Cl. ..... 416/70 R; 440/101

[58] Field of Search ..... 416/69, 70 R; 440/101

[56] References Cited

U.S. PATENT DOCUMENTS

| | | | |
|---|---|---|---|
| 2,526,863 | 10/1950 | Gilliam | 416/70 |
| 2,578,208 | 12/1951 | Schmitt . | |
| 4,233,925 | 11/1980 | Proctor | 416/70 |
| 4,303,402 | 12/1981 | Gooding | 440/101 |
| 4,493,663 | 1/1985 | Richmond | 416/70 |
| 4,842,482 | 6/1989 | Beckerer, Jr. | 416/70 |

FOREIGN PATENT DOCUMENTS

| | | | |
|---|---|---|---|
| 1256660 | 3/2962 | France | 416/70 |

*Primary Examiner*—John T. Kwon

[57] ABSTRACT

A more efficient paddle construction having a blade and a stem extending there from and wherein the blade has a rippled like surface which are latitudinally running wave like curled fins. This arrangement is such that there is a greater resistance to the flow of water up and around the blade when the paddle is being drawn in a scooping propelling stroke.

3 Claims, 3 Drawing Sheets

WAVE PADDLE

BACKGROUND OF THE INVENTION

1. Field of the Invention

This invention relates to the improvements in paddles.

While the simplicity of the standard paddle has served man through the millenniums there is a fault in its efficiency. I have discovered that as the paddle is drawn through the pull stroke the blade is mostly perpendicular to the surface only at the beginning of the draw, as the blade continues to be drawn backwards it angles acutely up the surface which causes the water to flow up the blade and over the edges. A substancial amount of energy is transformed into turbulance causing a certain amount of work to be lost.

2. Discription of Prior Art

There are a few paddle designs that have approached this problem, such a Schmitt in U.S. Pat. No. 2,578,208, issued December, 1951, which shows a spoon in which the handle of the spoon is angled with respect to the bowl portion. Gooding in U.S. Pat. No. 4,303,402, issued December, 1981, also shows a spoon like action in the paddle. Becker in U.S. Pat. No. 4,842,482, issued June, 1989, discloses flanges on the edges which traps the flow of water around the paddle. Juergens in German patent No. P4,300,324.9, issued in July, 1994, shows there is a curve in the paddle to improve the force of the blade.

None of these references discloses the unique design and construction of the paddle of the present invention.

SUMMARY OF THE INVENTION

The above disavantages and drawbacks of a standard paddle is largely corrected by this invention which has a novel and improved blade which is both simple in construction and characterized by a much higher thrust efficency than conventional paddles.

This is accomplished by the provision of a paddle construction comprising of a blade and a manipulator stem extending from the blade, said blade having a rippled like surface which are generally latitudinally running curled fins in a wave like formation which directs the flow of water downward and inward by said curled fins. This impedes the flow of water up or around the blade when the paddle is being drawn in a scooping propelling stroke.

A significantly higher thrust efficiency is achieved in comparision to a conventional paddle with the same blade size.

The disclosed construction has special applicability to the field of boating, as for example such as propelling a canoe or other craft in comparision to other blades. A wider blade than a conventional paddle which increases the thrust has to be held farther out from the boat's side when it is used. This creates a greater strain on the paddlers shoulders because the center of balance is more off set. A longer blade than the conventional paddle which also increases the thrust has to be lifted higher out of the water and is more difficult to use in shallow water.

Other features and advantages of the embodiment will hereinafter appear.

DISCRIPTIONS OF THE DRAWINGS

DISCRIPTION OF THE PREFERRED EMBODIMENTS

Figure 1:
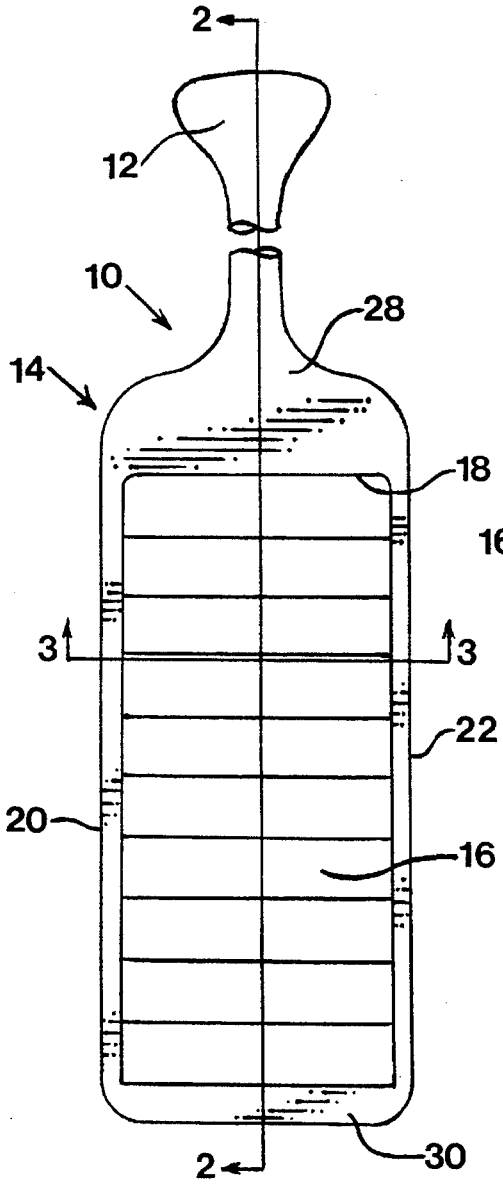
FIG. 1 is a top view plan of the paddle of this invention.
Figure 2:
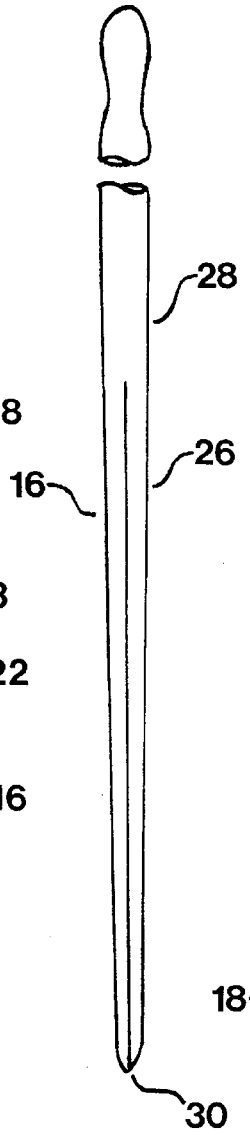
FIG. 2 is a side elevation of the paddle of FIG. 1.
Figure 3:
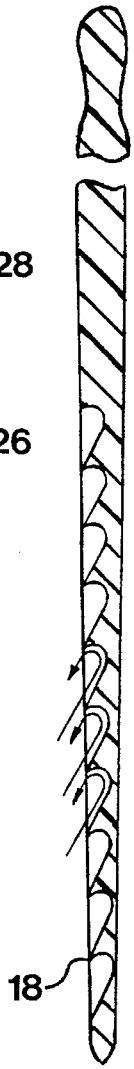
FIG. 3 is a cross section of the paddle of FIG. 1. taken along the line 2—2 of FIG. 1.
Figure 4:
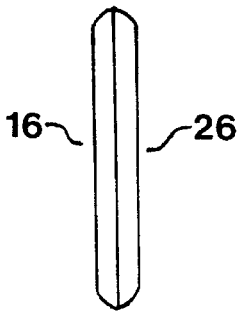
FIG. 4 is a end elevation of the paddle of FIG. 1.
Figure 5:
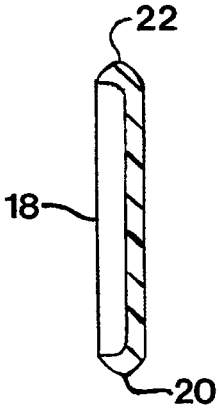
FIG. 5 is a cross section of the paddle of FIG. 1. taken along the line of 3—3.

By way of example, referring first to FIG. 1–5 and in accordance with the present invention, there is illustrated a novel and improved paddle intended for the use in propelling a watercraft such as a canoe, this device being referred by the numeral 10, and comprising a handle 12 and a blade 14. There are two substancially flat body portions on the blade 14 herein called blade side 16 and 26 which is shown in FIG. 2 and FIG. 4.

In accordance with the present invention for the purpose of improving the efficency of the paddle 10 there are latitudinally running curled fins 18 molded onto the blade side 16. The curled fins 18 are in a wave like formation which is longitudinally placed down the blade side 26 from the blade top 28 to the blade end 30 this is shown in FIG. 1 and cross section FIG. 3. The opposite blade side 26 of the blade 14 is unmodified. The curled fins 18 protruding from the surface of the blade side 16, points away from the longitudinal centerline of the paddle 10 which is shown in cross section FIG. 3 The curled fins 18 extend to the longitudinal blade edges 20 and 22 of the blade 14. Depending upon the structural integrity of the blade 14 the curled fins 18 extend the complete latitudinal length of the blade side 16 or stops short of the longitudinal blade edges 20 and 22 of the blade 14 allowing for edge reinforcement of the blade 14 which is shown in FIG. 1 and cross section FIG. 5.

The scooping action of the pull stroke creates a cyclone effect in the curled fins 18 redirecting the fluid back down into the water stream as shown with arrows in cross section FIG. 3. This provision of the curled fins 18 retards the amount of fluid which passes over and around the blade 14 improving the thrust efficency of the paddle 10. Another embodiment variation of the invention is shown in FIG. 6–9 wherein like reference numerals having a suffix "a" has been assigned to simular parts.

Figure 6:
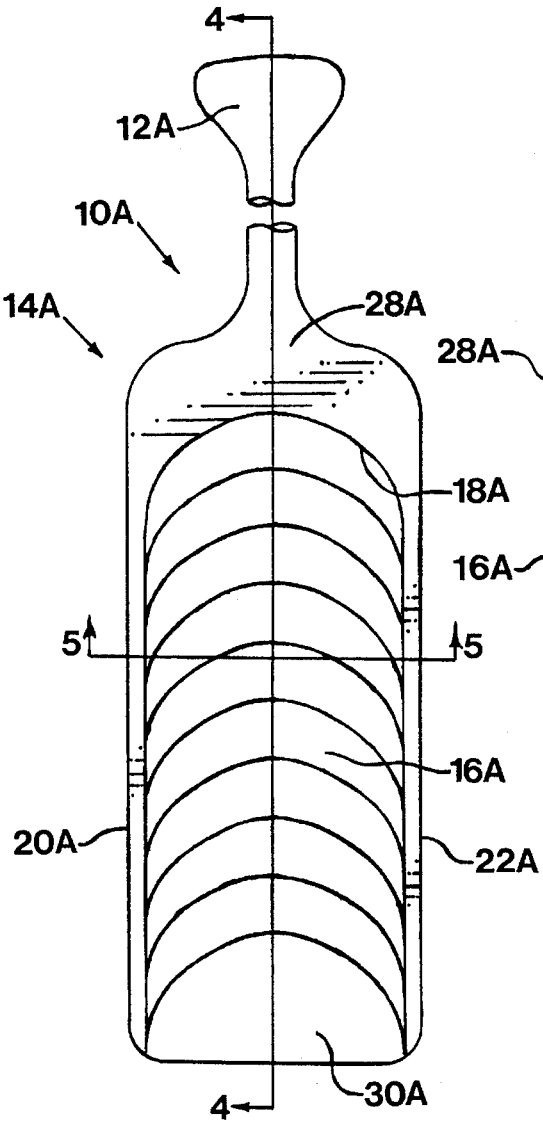
FIG. 6 is a top plan view of a modified paddle of this invention.
Figure 7:
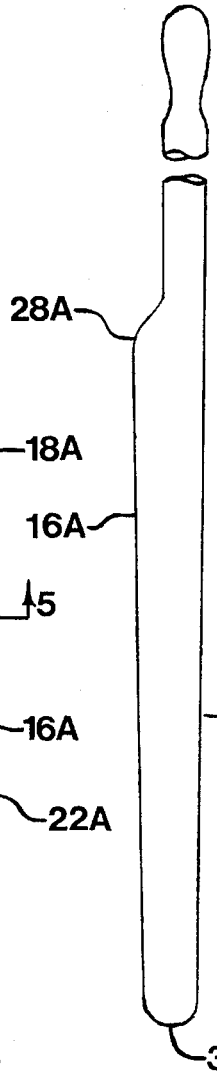
FIG. 7 is a side elevation of the paddle of FIG. 6.
Figure 8:
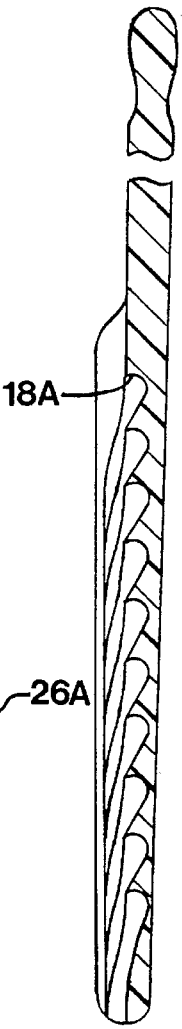
FIG. 8 is a cross section of the paddle of FIG. 6 taken along the line 4—4 of FIG. 6.
Figure 9:
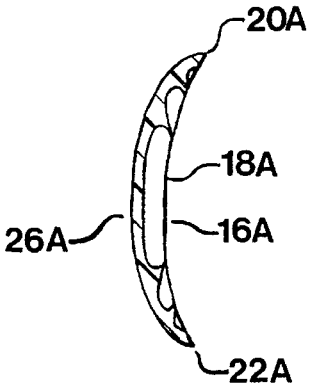
FIG. 9 is a cross section of the paddle of FIG. 6 taken along the line 5—5.
Figure 10:
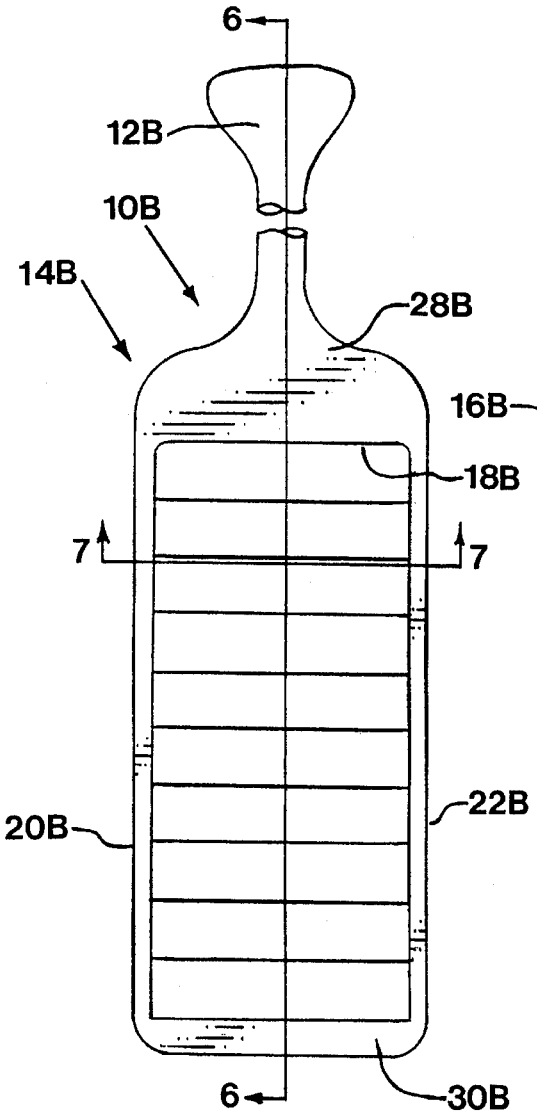
FIG. 10 is a top view of another modification of the paddle of this invention.
Figure 11:
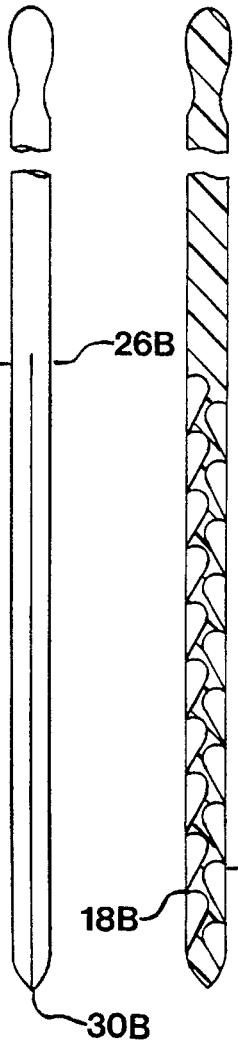
FIG. 11 is a side elevation of the paddle of FIG. 10.

By the invention the paddle 10*a* has two modifications, one of which is that the blade 14*a* is curved toward the longitudinal axis of the paddle 10*a*, blade side 16*a* is concave and blade side 26*a* is convex which is shown in cross section FIG. 9. The other variation in this modification is there are generally latitudinally running curled fins 18*a* in a wave like formation molded onto the blade side 16*a* as discribed previously in the first embodiment. However starting at the longitudinal axis of the blade side 16*a* the curled fins 18*a* fan out at a down ward angle, away from the longitudinal centerline of the paddle 10*a*. Thus creating an inverted U as shown in FIG. 6, the angle of the curled fins 18*a* from the longitudinal centerline of the paddle 10*a* varies 0 degrees to 90 degrees.

This cupped blade 14*a* with angled curled fins 18*a* directs the flow of water back toward the longitudinal axis of the blade side 16*a* during a scooping pull stroke, thus inhancing the impedement of water around the blade 14*a*.

Another embodiment modification of the invention is shown in FIG. 10–13 wherein like reference numerals having a suffix "b" has been assigned to simular parts.

Figure 12:
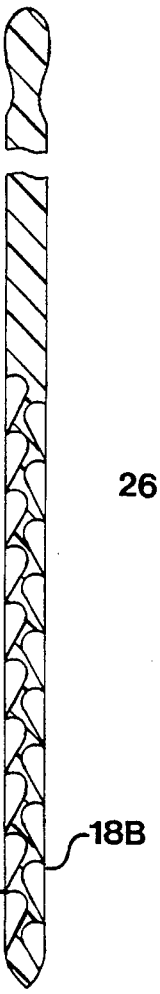
FIG. 12 is a cross section of the paddle of FIG. 10 taken along the line 6—6 of FIG. 10.
Figure 13:
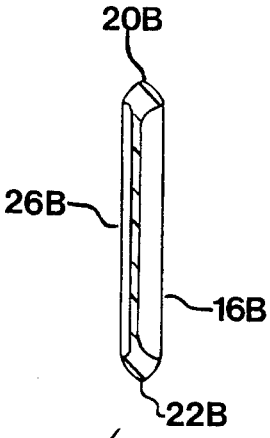
FIG. 13 is a cross section of the paddle of FIG. 10 taken along the line 7—7.

By the invention there is a modified paddle 10*b* in which there are curled fins 18*b* molded onto both blade sides 16*b* and 26*b* as shown in cross section FIG. 12. All aspects of the first embodiments and the inverted U shaped curled fins 18*a* can be incorporated into this modification.

A related object of the invention is to provide an improved paddle as above set forth wherein part or all of the device can be just as readily molded of plastic or cast as made from conventional wooden material.

The disclosed embodiment has been found to be more efficient as determined in comparable tests performed with working models, as such it is to represent an advance improvement in the field of paddles.

The foregoing is considered as illustrative only of the principles of the invention. Further, since numerous modifications and variations will readily occur to those skilled in the art, it is not desired to limit the invention to the exact construction and operation shown and described and accordingly all suitable modifications and equivalents may be resorted to falling within the scope of the invention.

What is claimed is:

1. A paddle for propelling a water craft, said paddle comprising of a blade, a straight shaft connected to said blade, a handle on said shaft at the opposite end from said blade, said blade having curled fins protruding from at least one side of said blade, said curled fins are placed generally latitudinally across to the edge of said blade.

2. A paddle of claim 1:

said curled fins are curved generally latitudinally across to the edge of said blade.

3. A paddle of claim 2:

said curled fins are placed, in a longitudinal formation down said blade.

* * * * *